US009423226B2

(12) United States Patent
Cillaut et al.

(10) Patent No.: US 9,423,226 B2
(45) Date of Patent: Aug. 23, 2016

(54) SPIN-STABILIZED PROJECTILE THAT EXPELS A PAYLOAD

(71) Applicant: NEXTER MUNITIONS, Versailles (FR)

(72) Inventors: Nicolas Cillaut, Bourges (FR); Cédric Martinon, Bourges (FR)

(73) Assignee: NEXTER MUNITIONS, Versailles (FR)

( * ) Notice: Subject to any disclaimer, the term of this patent is extended or adjusted under 35 U.S.C. 154(b) by 0 days.

(21) Appl. No.: 14/647,168

(22) PCT Filed: Nov. 22, 2013

(86) PCT No.: PCT/FR2013/052823

§ 371 (c)(1),
(2) Date: May 26, 2015

(87) PCT Pub. No.: WO2014/080136

PCT Pub. Date: May 30, 2014

(65) Prior Publication Data

US 2015/0308803 A1 Oct. 29, 2015

(30) Foreign Application Priority Data

Nov. 23, 2012 (FR) ..... 12 03211

(51) Int. Cl.
*F42B 12/22* (2006.01)
*F42B 12/64* (2006.01)
*F42B 12/62* (2006.01)

(52) U.S. Cl.
CPC ..... *F42B 12/64* (2013.01); *F42B 12/62* (2013.01)

(58) Field of Classification Search
CPC ..... F42B 12/34; F42B 12/24; F42B 12/22; F42B 15/00
USPC ..... 89/1.808; 102/506
See application file for complete search history.

(56) References Cited

U.S. PATENT DOCUMENTS 3,802,345 A * 4/1974 La Costa ..... F42B 5/03 102/522
4,444,117 A * 4/1984 Mitchell, Jr. ..... F42B 12/58 102/489

(Continued)

FOREIGN PATENT DOCUMENTS

CH 85741 * 10/1919 ..... F42B 12/62
CH 85741 A 7/1920
EP 2578987 A1 4/2013
GB 460516 A 1/1937

OTHER PUBLICATIONS

Feb. 24, 2014 International Search Report issued in International Patent Application No. PCT/FR2013/052823.

(Continued)

*Primary Examiner* — Samir Abdosh
(74) *Attorney, Agent, or Firm* — Oliff PLC

(57) ABSTRACT

The invention relates to a spin-stabilized projectile including a body enclosing a payload formed by a group of sub-projectiles that can be dispersed over a trajectory under the action of a pyrotechnic charge. The projectile is characterized in that the pyrotechnic charge is formed by a detonation relay that is separated from the payload by a piston slidably mounted in the body, said piston comprising a recess covering the detonation relay.

7 Claims, 2 Drawing Sheets

(56) References Cited

U.S. PATENT DOCUMENTS

| | | | | |
|---|---|---|---|---|
| 4,838,167 | A * | 6/1989 | Prahauser | F42B 4/26 102/334 |
| 7,210,410 | B1 | 5/2007 | Widener | |
| 7,231,876 | B2 * | 6/2007 | Kellner | F42B 12/204 102/491 |
| 2003/0167956 | A1 * | 9/2003 | Kellner | F42B 12/204 102/517 |

OTHER PUBLICATIONS

Feb. 24, 2014 Written Opinion issued in International Patent Application No. PCT/FR2013/052823.

Oct. 9, 2013 Search Report issued in French Patent Application No. 1203211.

Oct. 9, 2013 Written Opinion issued in French Patent Application No. 1203211.

* cited by examiner

SPIN-STABILIZED PROJECTILE THAT EXPELS A PAYLOAD

The technical field of the invention is that of spin-stabilized projectiles comprising a body enclosing a payload formed by a group of sub-projectiles that can be dispersed over a trajectory by a pyrotechnic charge.

These projectiles are usually medium-caliber projectiles (caliber between 20 mm and 70 mm) and are used for anti-aircraft defence.

The sub-projectiles are usually spheres or cylinders made of metal, such as steel or tungsten.

The dispersion of sub-projectiles in front of a target, such as a missile or an aircraft, allows to destroy the latter.

From patent GB460516 is known a particular projectile, the body of which encloses seven complete cartridges each comprising a case and a bullet positioned in a rifled barrel. The cartridges are immobilized with respect to the body at their rear base abutting against a stop plate. Each cartridge is provided with a primer which is stricken by a firing pin pushed by a piston. A pyrotechnic charge is initiated over the trajectory and pushes the piston against the action of a spring, causing the primers of the cartridges to be stricken, and thus the bullets to be fired. Here, there is no projection of the entire payload from the projectile body, but the firing of the cartridges. The cases of the cartridges remain in the body after firing of the latter. Such a system is complex and only the bullets, thus a small part of the payload, are ejected.

From patent CH85741 is known a projectile for destroying balloons or airships, which comprises different pyrophoric sub-projectiles which are ejected from the projectile body after having been initiated. The ejection is caused after a delay by the initiation of the charge. This charge is not a detonation relay since it is initiated by a slow-burning powder charge (pyrotechnic relay) the outlet of which can initiate only a pyrotechnic composition or a black powder charge.

From U.S. Pat. No. 3,954,060 is known a projectile comprising a pile of metal flechettes which are dispersed by means of a pyrotechnic charge generating a gas pressure.

Before the expulsion, the projectile warhead is cracked and opens into petals-like shape under the action of another pyrotechnic device. The sub-projectiles are housed in several one-piece cups piled on top of each other from the rear of the shell body up into the warhead. A rear piston is connected to the shell body and pushes the cups out of the body, once the warhead and its content have been ejected. Such a solution is particularly complex and imposes the implementation of several pyrotechnic gas-generating devices operating in sequence.

From patent EP0698774 is also known a projectile in which the dispersion of sub-projectiles is obtained by the initiating of an explosive charge separated from the payload by a wall, and not of a gas-generating composition.

When initiating the charge, the body cover is radially cut at the wall and the body opens from the rear along longitudinal stress raisers.

Such a mode for opening the body slows the axial ejection of the sub-projectiles which remain held for a certain time, by the projectile body, abutting against the warhead. This ejection mode with a radial deployment has that disadvantage that it does not provide the sub-projectiles with an excess axial speed during operation, which reduces the perforating efficiency of the sub-projectiles.

The object of the invention is to provide a projectile structure having a simple design and nevertheless reliably ensuring an axial and forward ejection of the sub-projectiles. With the invention, the ejection is performed with a speed which is increased with respect to the residual speed of the projectile. About 40 m/sec are provided in addition to a speed of about 500-800 m/sec, namely an increase of 5-8% of the speed of the sub-projectiles.

Thus, the invention relates to a spin-stabilized projectile comprising a body enclosing a payload formed by a group of sub-projectiles which can be dispersed over a trajectory under the action of a pyrotechnic charge integral with a rear part of the body, the body carrying at its front part a ballistic warhead, the payload being entirely ejected from the body by projecting toward the front of the projectile a piston slidably mounted in the body, the projectile being characterized in that the pyrotechnic charge is composed of a detonation relay separated from the payload by the piston, the piston comprising a recess covering and surrounding the detonation relay, the latter being not directly in contact with the piston.

Advantageously, the piston will have an external profile corresponding to that of the inner housing of the body.

The external profile of the piston could be hexagonal, for example.

The piston could have a thickness between 7.5 mm and 10 mm.

According to an embodiment, the payload could be arranged between the piston and a front thrust plate which bears against the warhead.

The front thrust plate could be provided with an inner recess having a hexagonal profile and receiving the payload.

According to an embodiment, the projectile could comprise a support ring which will be integral with the body and on which the piston will bear.

The invention will become more apparent when reading the following description of a particular embodiment, the description being made with reference to the appended drawings in which.

Figure 1:
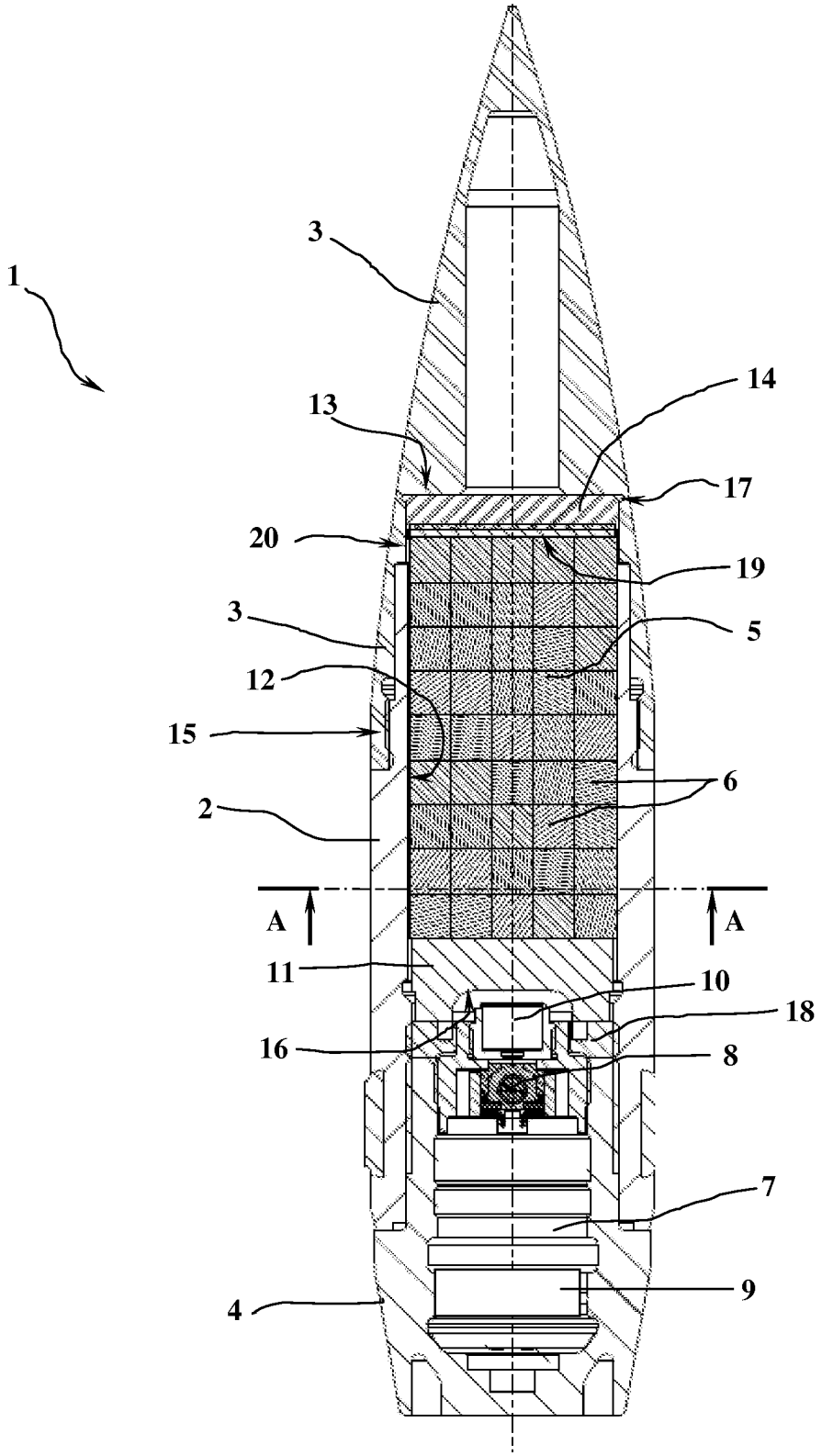
FIG. 1 is a longitudinal cross-sectional view of an embodiment of a projectile according to the invention.

With reference to FIG. 1, a projectile 1 according to an embodiment of the invention comprises a body 2 which is closed at its front part by a ballistic warhead 3 and at its rear part by a base 4 screwed to the body 2.

The body 2 comprises an inner housing 12 enclosing a payload 5 formed by a group of sub-projectiles 6 which can be dispersed over a trajectory. Following the example shown here, the sub-projectiles 6 are cylinders made of steel or tungsten and which are piled in columns.

To ensure that the sub-projectiles 6 are driven in rotation by the body 2, the inner housing 12 of the latter has a hexagonal-shaped profile matching the contour of the cylindrical sub-projectiles.

This hexagonal profile is the most suitable for the driving of cylindrical columns. Other shapes could also be possible, for example cylindrical grooves evenly angularly distributed and each corresponding to a column of sub-projectiles.

Figure 2:
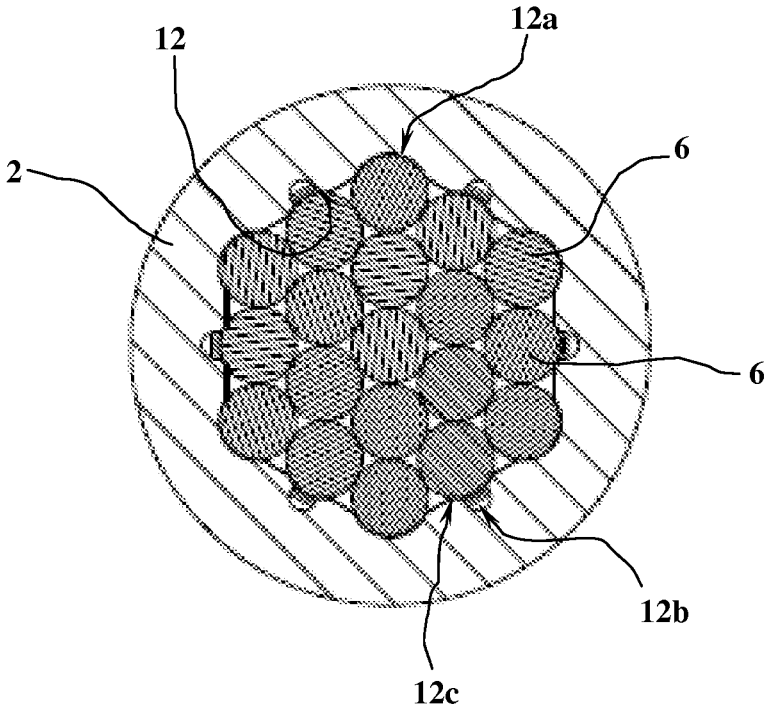
FIG. 2 is a transverse cross-sectional view of this projectile, performed along the plane AA the mark of which is visible in FIG. 1.

As it can be more particularly seen in FIG. 2, the hexagonal profile of the housing 12 is provided with rounded grooves 12*a* at the apexes of the hexagon. These grooves 12*a* extend on the entire length of the body 2 and have a radius of curvature equal to that of the cylindrical sub-projectiles 6.

Furthermore, the housing 12 is provided with a furrow 12*b* at each center of the hexagon sides. These furrows 12*b* extend on the entire length of the body 2 and each open to a cylindrical profile 12*c* receiving a column of sub-projectiles 6.

In FIG. 2, it can be noted that each side of the hexagonal profile of the housing 12 is provided with three sub-projectiles 6. The column of sub-projectiles 6 arranged at the center of each side is thus held by a furrow 12*b*.

The base 4 encloses a fuze 7 which conventionally comprises a safety and arming device and a detonator 8 the initiation of which is controlled by a programmable electronic module 9.

When the detonator 8 is brought in its arming position by the safety and arming device, it faces a detonation relay 10.

This relay 10 is a pyrotechnic detonating charge which is initiated by the shock wave from the detonator 8 and causes a detonation. "Detonation" means a self-sustaining exothermic chemical reaction in which a shock wave precedes the reaction front and moves at a speed higher than the sound velocity of the composition. A detonation speed is about several thousands meters per second.

The detonation relays are generally used to cause the detonation of an explosive charge, for example a shell. A relay 10 formed by compressed hexogen could be used.

For comparison purposes, a gas-generating composition is initiated by combustion, namely with a reaction speed of a few meters per second. It is the same for a propellant powder, the reaction speed of which is about a few tens of meters per second.

According to the invention, the detonation relay 10 is separated from the payload 5 by a piston 11 slidably mounted in the body 2. To this end, the piston will have a hexagonal external profile to follow the hexagonal profile of the housing 12 of the body 2 and to be driven in rotation with the projectile, thereby avoiding problems of gyroscopic instability. If the housing 12 has another profile shape, for example cylindrical grooves which are evenly angularly distributed, the piston 11 will have a profile corresponding to that of the housing 12 so as to be able to slide in the latter and be rotatably integral with the body 2.

As it can be seen in FIG. 1, the payload 5 is arranged between the piston 11 and a front thrust plate 14 bearing against a shoulder 13 of the warhead 3. The thrust plate 14 is cup-shaped and therefore comprises an inner recess delimited by a thin wall 20. The wall 20 is disposed between the weapon 3 and the payload 5.

The outer surface of this wall 20 is cylindrical and in contact with the warhead and the inner surface of this wall 20 has a hexagonal profile similar to that of the housing 12 of the body. It is by means of this profile that the thrust plate 14 is driven in rotation by the payload 5. Such an arrangement ensures the stability of the projectile in flight, by avoiding the rotation of the thrust plate 14 with respect to the payload 5.

The warhead 3 is attached to the body 2 by a screw thread 15. It comprises a breaking groove 17 which will be cut during operation of the detonation relay 10 and thus will allow the forward ejection of the payload 5.

According to the embodiment shown in FIG. 1, the piston 11 comprises a recess 16 covering and surrounding the detonation relay 10. The latter is thus not directly in contact with the piston 11. Such an arrangement allows to prevent the piston 11 to be damaged during operation of the detonation relay 10.

This recess is essential for the proper operation of the forward ejection by detonation. It has a depth between 2 and 4 mm. A support ring 18 is disposed between the piston 11 and the fuze 7, the function thereof is to take up the inertial forces of the payload 5 applied to the piston 11 during firing. The fuze 7 is thus not damaged.

This support ring 18 can be optional in the case where taking up the inertial forces of the payload 5 is ensured by the piston 11 directly bearing against a bearing of the body 2 of the projectile (extent not shown, which would be arranged instead of the ring 18).

The assembly of the projectile 1 is performed as follows:

The support ring 18 is screwed and stuck in its correct position in the body 2.

The piston 11 is then inserted in the body 2 from the front of the latter, until it abuts against the support ring 18, and then the payload 5 is inserted in the body 2. To this end, it will be possible to temporarily make the sub-projectiles 6 integral with each other, for example using a plastic film surrounding the piles of sub-projectiles 6.

Then, the front thrust plate 14 is positioned on the payload 5 with one or more axial wedging sheets 19 between them, and the warhead 3 is screwed and stuck to the projectile body 2.

Finally, the base 4 enclosing the fuze and carrying the detonation relay 10 is screwed to the rear part of the body 2.

The operation of the projectile according to the invention is as follows:

The fuze 7 has received, before firing (or over the trajectory), a programming for the time of dispersion of the sub-projectiles 6. This programming does not belong to the invention and it is thus not necessary to describe it in a detailed manner.

At the desired time, the detonator 8 is initiated by the electronic module 9. It causes the detonation of the relay 10. The shock wave from the relay 10 will cause the piston 11 to be projected toward the front of the projectile. This shock wave spreads through the piston 11, the payload 5 and the plate 14. It is sufficient to cut the breaking groove 17 of the warhead 3 and to ensure the projection of the entire payload 5 through the front opening of the warhead 3 thus cut.

In order to prevent any deformation or destruction of the piston 11 by the shock, the piston will be provided with a thickness between 7.5 mm and 10 mm.

Due to the use of a detonation relay 10, the cutting of the warhead 3 is reliably and quickly obtained under the sole effect of the shock wave. The tests have shown that the shock also allows to axially eject the payload 5 without requiring a longitudinal cut the body and without requiring a relative tightness between the piston 11 and the body 2.

The solution is thus simpler than that described by patent EP698774. It is also simpler than that described by U.S. Pat. No. 3,954,060 which implements a gas-generating composition. Indeed, with the invention, it is not necessary to provide sealing means between the piston 11 and the body 2, which means would be essential with a gas-generating composition. Furthermore, the pyrotechnic chain used by the invention is a conventional detonating chain such as implemented in an explosive projectile. The development of the projectile according to the invention is thus simplified.

The invention claimed is:

1. A spin-stabilized projectile comprising a body enclosing a payload formed by a group of sub-projectiles which can be dispersed over a trajectory under the action of a pyrotechnic charge integral with a rear part of the body, the body carrying at its front part a ballistic warhead, the payload being entirely ejected from the body by projecting toward the front of the projectile a piston slidably mounted in the body, wherein the pyrotechnic charge is composed of a detonation relay that is separated from the payload by the piston, the piston comprising a recess covering and surrounding the detonation relay, the latter being not directly in contact with the piston.

2. The projectile according to claim 1, wherein the piston has an external profile corresponding to that of the inner housing of the body.

3. The projectile according to claim 2, wherein the external profile of the piston is hexagonal.

4. The projectile according to claim 1, wherein the piston has a thickness between 7.5 mm and 10 mm.

5. The projectile according to claim 1, wherein the payload is arranged between the piston and a front thrust plate which bears against the warhead.

6. The projectile according to claim 5, wherein the front thrust plate is provided with an inner recess having a hexagonal profile and receiving the payload.

7. The projectile according to claim 1, wherein it comprises a support ring which is integral with the body and on which the piston bears.

* * * * *